United States Patent [19]

Peretz et al.

[11] 4,224,625

[45] Sep. 23, 1980

[54] ANTENNA

[75] Inventors: Maurice M. Peretz, St. Ramat-Gan; Yhiel Haimovich, Nes Ziona, both of Israel

[73] Assignee: Elbit Computers Ltd., Haifa, Israel

[21] Appl. No.: 32,804

[22] Filed: Apr. 24, 1979

Related U.S. Application Data

[63] Continuation of Ser. No. 879,927, Feb. 22, 1978, abandoned.

[51] Int. Cl.[2] ..... H01Q 9/18

[52] U.S. Cl. ..... 343/750; 343/715

[58] Field of Search ..... 343/711–715, 343/749, 750, 745, 850

[56] References Cited

U.S. PATENT DOCUMENTS

| | | | |
|---|---|---|---|
| 3,381,222 | 4/1968 | Gray | 343/750 |
| 3,689,928 | 9/1972 | Felsenheld | 343/749 |

*Primary Examiner*—David K. Moore

*Attorney, Agent, or Firm*—Sughrue, Rothwell, Mion, Zinn and Macpeak

[57] ABSTRACT

An antenna for communication sets on military vehicles is provided which is interchangeable with existing military antennae, and is suitable to operate with the VRL-12 family. It is adequate to an input impedance of 50 ohm nominally, operates in the frequency band of 30–76 MHZ and is thus suitable for all communication sets operating in this frequency band. It accommodates transmitter power of 100 watts.

The coupler is made of armoured steel and the whip is shorter and thinner than that of prior units. It is made of such materials which make it a more rugged and less vulnerable in the battle field.

11 Claims, 5 Drawing Figures

ANTENNA

This is a continuation of application Ser. No. 879,927, filed Feb. 22, 1978, now abandoned.

The present invention relates to an antenna for communication sets on military vehicles.

Most military vehicles such as tanks, command cars, half-trucks, jeeps, armoured personnel, weapon-carriers, crew serviced weapons, or landing craft, and the like, are provided with communication sets. The sets, in order to be efficient for transmission and reception, have to be provided with an adequate antenna. The transceiver antenna currently used in most military vehicles in the U.S., Israel and the NATO countries, is the center-fed U.S. AN-1729. This antenna is provided with an antenna coupler system and a 3 m whip having a cross-section diameter at the base of approximately 2 cm tapered to about 0.75 cm at the top. The relatively tall whip increases appreciably the profile height of the vehicle supporting the antenna divulging its presence and location from large distances and rendering camouflage techniques more difficult. Often, to overcome this height problem during action in the field or when tactical camouflage is desired, the military resort to bending the antenna, in which case communication is either non-existant or its quality drastically degraded.

Moreover, the known antenna is very vulnerable in the battle field. The whip, being of a composite of wire mesh and fiberglass, shatters under the thrust of nearby explosions or breaks at the feed point when hit by shrapnel. In either case radio communication is impaired or completely ceased. Similarly, since the antenna coupler system is partially made of thermo setting material, it may also be easily damaged by shrapnel, resulting in communication difficulties.

It has thus been desirable to overcome these drawbacks, and to design a new antenna; the coupler of which would be of armoured steel, and the whip of which would be shorter and thinner and therefore could not be seen even from relatively short distances. Moreover, it should be constructed from such materials which would make it more rugged and less vulnerable in the battle field.

However, it would be very unsatisfactory if all conventional communication sets should have to be modified or replaced in order to accommodate the new antenna. Thus another object of the invention is to provide such a new antenna which would be interchangeable with existing military units.

Said antenna should, as in the case of existing military units, be adequate to an input impedance of 50 ohm nominally. It should operate at least in the frequency band of 30–76 MHz sub-divided into ten sub-bands which are identical to those of existing equipment. It should also accommodate transmitter power of 100 watts. As indicated, the antenna should be interchangeable with existing equipment, and should also be transferable from one vehicle to another without impairing its input and radiation characteristics. Moreover, the new antenna should also be suitable for all communication sets—receiving and/or transmitting—operating in a frequency band of 30–80 MHz.

The present invention thus consists of an antenna coupler system and whip comprising:

A lower housing having a base being provided with connecting means to the vehicles, said housing containing a control unit comprising:

(a) mechanical and electrical means connectable to the communication set;
(b) a remote control multipin-connector;
(c) a RF connector;
(d) a control motor;
(e) a relay; and,
(f) two rotary selection wafers;

all said means being suitably connected to each other; the housing being connected via a flange to A second housing comprising:

(a) a helical-re-entrant-cavity resonator the parameters of which match the electronic tune system;
(b) an electronic tune system, said system comprising:
(1) Ten electrical tuning circuits composed of shorted line, inductors and, when necessary, capacitors, each tuning circuit being designed to match the specific frequency sub-band within the 30–80 MHz frequency band and adjusted to the pre-selected height of the whip antenna;
(2) two top rotary selector wafers each arranged at one end of said tuning circuits;

said second housing being connected via an insulating bushing to a base spring arrangement comprising at its upper end connecting means for a removable antenna whip.

Both housings include a common rotatable axle which is located in the line of symmetry of the housings and the antenna whip system; and the rotatable axle is actuated by a control motor which is the mechanical link between the rotary selector wafers in both housings. The RF connector in the control unit is connected by way of a 50 ohm RF coaxial-line to the first rotary switch wafer of the electronic tune system; the shield of a section of the coaxial-line constituting the helical coil of the re-entrant-cavity resonator.

The lower housing is preferably made of aluminium. This housing is preferably terminated at the lower end by a connector protecting sleeve. The control unit is substantially the same as that utilized in existing military equipment. It preferably comprises also a manual frequency-selector.

The RF connector is preferably a BNC type and should be 50 Ohms nominally.

The second housing is preferably made of armoured steel.

The electronic tune unit has to be designed in such a manner that each electric circuit corresponds to one of the frequency sub-bands required (suitable parameters are given later on). The whole unit is preferably mounted on a silver plated brass plate. Said plate constitutes an imaginary ground for some of the tuning circuits and may serve as a terminating plate for the cavity resonator.

The parameters of said electrical circuits should preferably be chosen in such a manner that the height of the antenna unit should not exceed approximately 1.5 m.

The selector wafers are used to select a tuning circuit to operate at an elected frequency sub-band.

The insulating bushing at the feed point of the antenna insulates the antenna whip system from the metallic housing.

The whip antenna connecting means is identical to the antenna connecting means of existing auxiliary receivers. Thus the shorter and thinner antenna whip used for the antenna unit according to the present invention can be used also as an antenna for the said auxiliary receivers which are used on some of the military vehicles. This offers a low silhouette antenna pair for vehicles having a transceiver communication set and an auxiliary receiver.

Advantageously a cap is attached to said base spring means which may cover the whip connecting means for protection against dust and humidity when the whip is removed.

The antenna whip is preferably composed of three parts, namely:

a. tne whip proper;
b. an adaptor; and
c. the handle of the adaptor.

The whip is preferably made of stainless steel, and is much thinner and shorter than known whips. The whip has preferably at its needle-like top a small metallic sphere for protection against injury to personnel. Said whip is practically invisible from a distance beyond 100 m approximately. These features overcome the drawbacks of the taller and thicker whips utilized in existing units.

The whip adaptor is preferably made also of stainless steel whereas the handle is made preferably of cast neoprene.

The present invention will now be illustrated with reference to the accompanying drawings without being limited by them. In said drawings.

Figure 1:
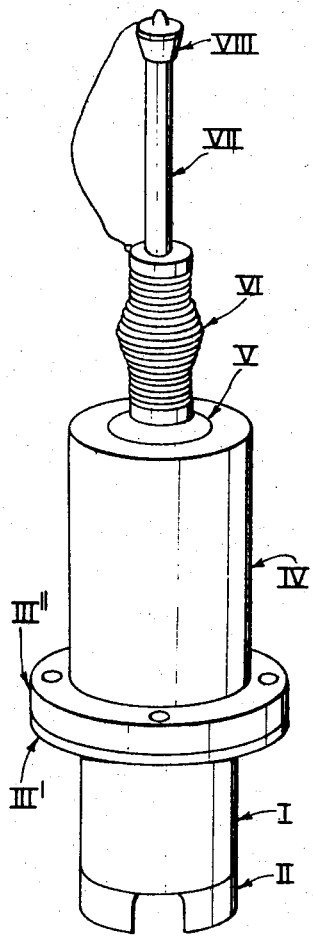
FIG. 1 shows a perspective outside view of the antenna coupler system according to the present invention.

The antenna coupler system illustrated in FIG. 1 comprises housing I containing the control sub-system and being provided with an integrated sleeve II for protection of the base connectors. Housing I is terminated by flange III' which is connected to flange III" which in turn terminates housing IV that contains the helical-re-entrant cavity resonator and the electronic tune sub-system. Said housing IV is connected via feed point insulating bushing V to spring system VI and through there to the antenna whip connecting means VII being covered by cap VIII. FIG. 1 does not show the antenna whip.

Figure 2:
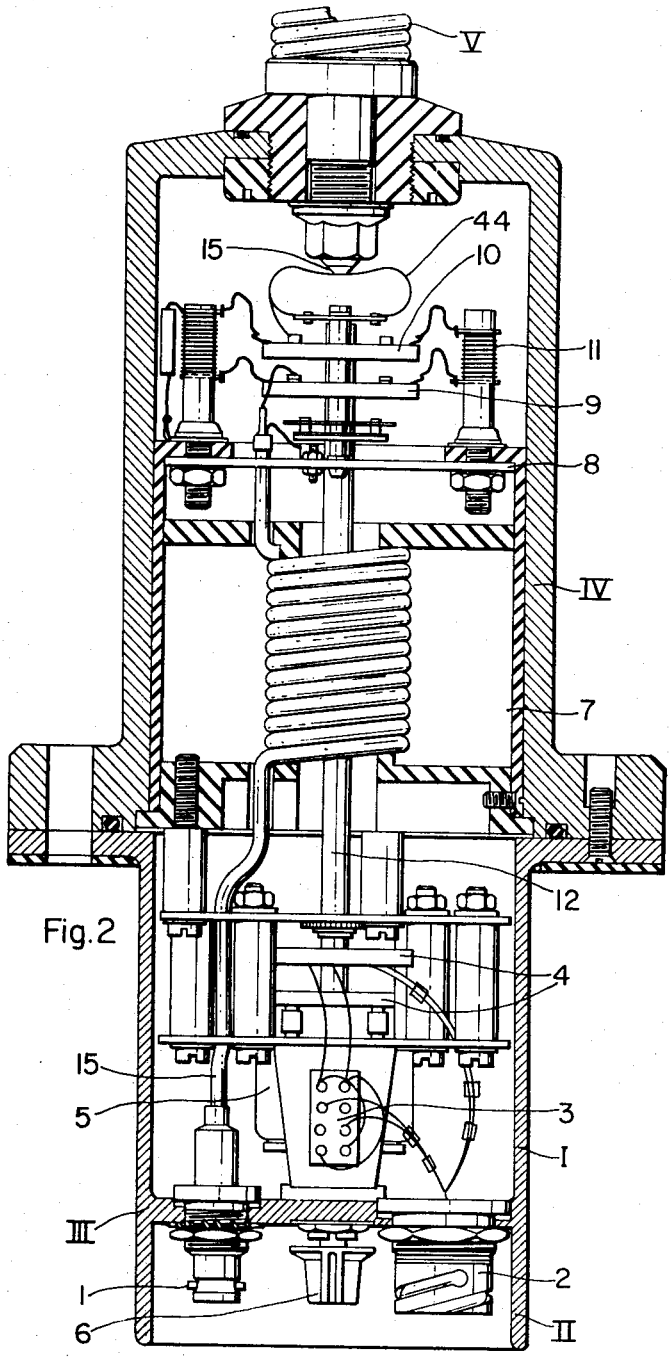
FIG. 2 shows a cross section of the antenna coupler system comprising the electronic tune sub-system, the helical-re-entrant cavity resonator and the control unit sub-system.

The cross section of FIG. 2 illustrates the:

housing I, integrated sleeve II, and the base connectors-plate III. The base connectors-plate III comprises RF connector 1 and remote control multipin connector 2 which is wired via relay 3 and rotary selector wafers 4 to motor 5 for automatic sub-band switching. The electrical means by which the connectors are cabled to the communication set as well as the remote control means are not shown. They are part of the transceiver set. Base connectors plate III also includes a selector knob 6 for manual sub-band switching if the antenna coupler is connected to transceivers without automatic switching capabilities.

Housing IV includes a helical-re-entrant cavity resonator 7. The terminating plate 8 of resonator 7 supports the top rotary selector and wafers 9 and 10 and is used as an imaginary ground for the tuning circuits 11 which are in turn connected between wafers 9 and 10. Said circuits are composed of suitable shorted line, inductors and/or capacitors as shown in FIG. 3.

The motor 5 actuates the selector wafers 9 and 10 via common axle 11 thereby selecting specific tuning circuits for a chosen frequency sub-band. Sub-band switching is automatic if the antenna coupler is connected to transceivers with automatic switching or can be switched manually if connected to transceivers without automatic switching capabilities.

The RF signal of the communication set is transmitted/received to/from the antenna system via the said RF connector coaxial-line 13 and the said top selector wafers 9, 10, tuning circuits 11 and the contact spring blade 14 at the root 15 of the spring system.

Figure 3:
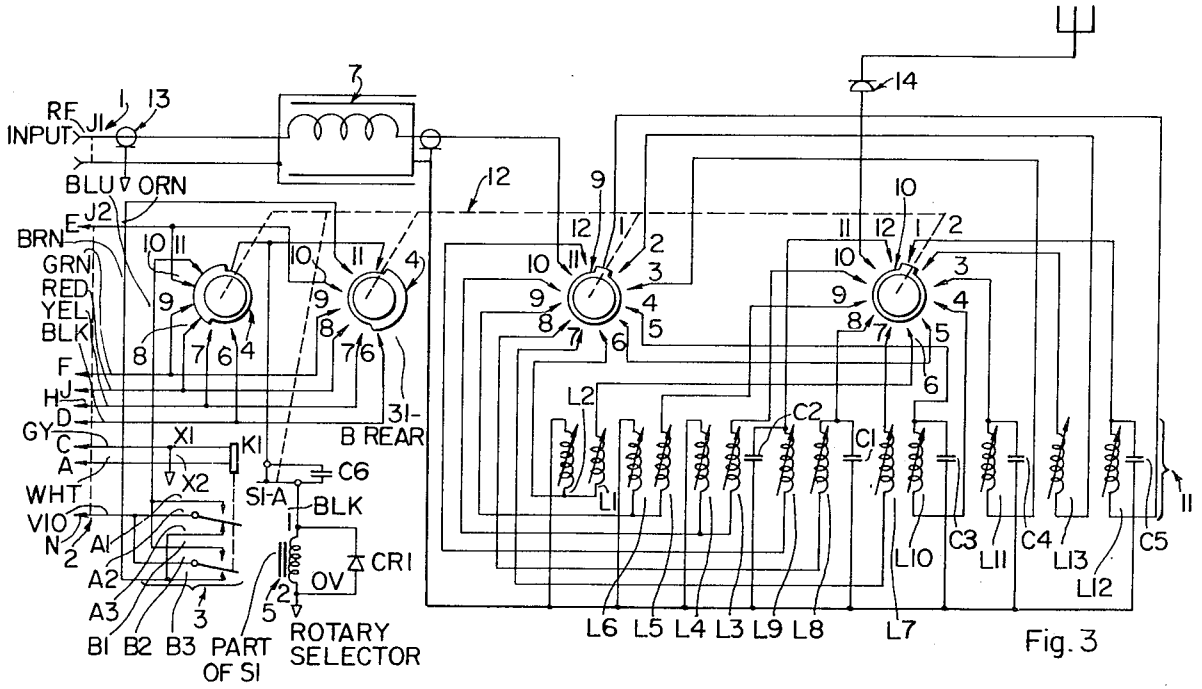
FIG. 3 shows the schematic diagram of the sub-systems illustrated in FIG. 2.

The schematic diagram of FIG. 3 presents the electrical wiring and earthing of the antenna coupler, the cross section of which was shown in FIG. 2. It shows the arrangement of the control switch selectors and that of the tuning circuits switch selector. It shows also the mechanical link between the control and the tuning circuits selectors.

Tuning circuits 11, suitably designed to fix-tune the whip antenna over specific sub-bands, are schematically shown in FIG. 3 in terms of inductors $L_1$ to $L_{13}$ and capacitors $C_1$ to $C_5$. The values in coil-turns of inductors L's and in picofarad (pf) of capacitors C's are given in Table I with respect to sub-bands within the total 30–88 MHz band (band segments with ordinal numerals 1, 2 . . . 10), and to the respective positions of the prongs on the two-wafer stack 9, 10. For example, band segment 1 corresponding to sub-band 30–33 MHz (as taken from Table II) is tuned by the inductors $L_1$ (16 turns) and $L_2$ (10 turns) connected between the prongs 6 of wafers 9, 10 and ground in accordance with the arrangement of FIG. 3. Similarly band segment 10 (70.5–88 MHz sub-band) corresponds to tuning coil $L_{13}$ (9 turns) between positions 2 of wafers 9, 10 etc. Radio frequency signals within band segment 1, sub-band 30–33 MHz, for example, are transmitted/received via free space and the whip antenna element passing through point contact 15 spring-blade 14, tuning circuit $L_1$, $L_2$, coaxial-line 13 and RF connector 1, ($J_1$ in FIG. 3). If, on the other hand, signals within sub-band 70.5–88 MHz (band segment 10) are to be efficiently transmitted/received by a communication set then the rotating central part of wafers 9, 10 is rotated manually or by remote control by means of motor 5 and axle 12 to create electrical continuity on wafer 10 between prong 11—permanently connected to spring-blade 14 pig tail and prong 2—permanently connected to one end of tuning circuit $L_{13}$ and on wafer 9 between prong 11—permanently connected to coaxial-line inner conductor and prong 2—permanently connected to the other end of tuning circuit $L_{13}$. Tuning circuit $L_{13}$, designed to tune the whip antenna in band segment 10 (70.5–88 MHz), is thus inserted in the path of RF signals between connector 1 and whip element 20 shown in FIG. 5. A similar process is followed to tune the whip antenna in any one of the 10 sub-bands, each time placing the appropriate tuning circuit in the path of RF energy between prongs 11 of wafers 9, 10. Table II gives the resistance to ground in ohms of the pins of the multipin DC connector 2 ($J_{2\text{-}A}$, $J_{2\text{-}C}$, $J_{2\text{-}D}$ . . . in FIG. 3 and in Table II) with respect to band segments (frequency sub-bands) and positions on lower two-wafer stack switch positions.

Table III gives the control voltages with respect to band segments, of the multipins connector 2 ($J_2$) supplied externally by communication sets having remote control capability. Wafers 4 and relay 3 of the control system sub-divide the band segment switching process into two bands A and B. In band A switching can be performed between band segments 1–5 and in Band B, between band segments 6–10, in accordance with the DC voltage (24, 0 volts) distributiion among the $J_{2\text{-}A}$, $J_{2\text{-}N}$, $J_{2\text{-}D}$ . . . pins of DC connector 2 ($J_2$).

TABLE I

| BAND SEG. | POSITION | COMPONENTS SYMBOL | TURNS | SYMBOL | TURNS | VALUE |
|---|---|---|---|---|---|---|
| 9 | 1 | L12 | 10 | C5 | | 5PF |
| 10 | 2 | L13 | 9 | | | |
| 8 | 3 | L11 | 9 | C4 | | 8.2PF |
| 7 | 4C | L10 | 8 | C3 | | 15PF |
| DIR"L | 5 | — | | — | | |
| 1 | 6 | L1 | 16 | L2 | 10 | |
| 4 | 7 | L7 | 3 | | | |
| 5 | 8 | L8 | 6 | C1 | | 39PF |
| 3 | 9 | L5 | 7 | L6 | 8 | |
| 2 | 10 | L3 | 10 | L4 | 7 | |
| 6 | 12 | L9 | 8 | C2 | | 25PF |
| NC | 11 | | | | | |

TABLE II

| FREQ. MHz | SWITCH POSITION | RESISTANCE TO GROUND - OHMS TERMINAL NO. J1 | J2-A | J2-C | J2-D | J2-E | J2-F | J2-H | J2-J | J2-N |
|---|---|---|---|---|---|---|---|---|---|---|
| 65–70.5 | 1 | INF. | 650 | 0 | 4.5 | 4.5 | 4.5 | INF. | 4.5 | INF. |
| 70.5–76 | 2 | 0 | | | | 4.5 | 4.5 | 4.5 | INF. | |
| 60–65 | 3 | INF. | | | | 4.5 | INF. | | | |
| 56–60 | 4 | | | | | INF. | 4.5 | | | |
| — | 5 | | | | 4.5 | 4.5 | | | | INF. |
| 30–33 | 6 | | | | INF. | | | 4.5 | | 4.5 |
| 42–47.5 | 7 | | | | | | | INF. | | |
| 47.5–53 | 8 | | | | | | 4.5 | 4.5 | INF. | |
| 37–42 | 9 | | | | | 4.5 | INF. | | 4.5 | |
| 33–37 | 10 | | | | | INF. | 4.5 | | | 4.5 |
| — | 11 | | | | | 4.5 | 4.5 | | | INF. |
| 53–56 | 12 | INF. | 650 | 0 | INF. | 4.5 | 4.5 | 4.5 | 4.5 | INF. |

TABLE III

| BAND SEG. | FREQ. MHz | BAND | CONTROL VOLTAGES (DC) RECEPTACLE J2 N | A | D | E | F | H | J |
|---|---|---|---|---|---|---|---|---|---|
| 1 | 30–33 | A | 24 | 24 | 24 | 24 | 0 | 0 | 0 |
| 2 | 33–37 | A | 24 | 24 | 0 | 24 | 0 | 0 | 0 |
| 3 | 37–42 | A | 24 | 24 | 0 | 0 | 24 | 0 | 0 |
| 4 | 42–47.5 | A | 24 | 24 | 0 | 0 | 0 | 24 | 0 |
| 5 | 47.5–53 | A | 24 | 24 | 0 | 0 | 0 | 0 | 24 |
| 6 | 53–56 | B | 24 | 0 | 24 | 0 | 0 | 0 | 0 |
| 7 | 56–60 | B | 24 | 0 | 0 | 24 | 0 | 0 | 0 |
| 8 | 60–65 | B | 24 | 0 | 0 | 0 | 24 | 0 | 0 |
| 9 | 65–70.5 | B | 24 | 0 | 0 | 0 | 0 | 24 | 0 |
| 10 | 70.5–76 | B | 24 | 0 | 0 | 0 | 0 | 0 | 24 |

Figure 4:
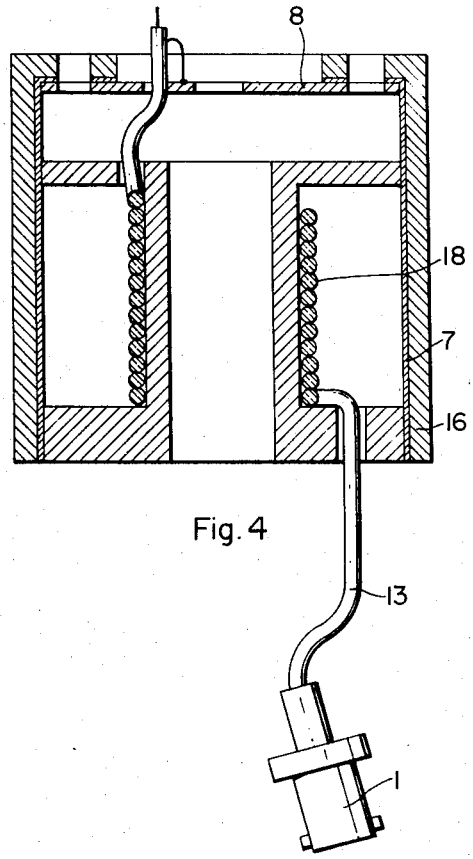
FIG. 4 shows an embodiment of the helical-re-entrant cavity resonator.

The resonator 7 illustrated in FIG. 4 consists of a cylindrical Noryl body 16 which is silver plated internally to form a metallic cavity of circular cross section. The shield of a section of the RF coaxial-line 13 coiled around a Noryl spool 17 constitutes the helical coil 18 of the re-entrant cavity resonator. The metallic plate 8 terminating the cavity is used to support the top rotary selector wafers 9 and 10 and to provide an imaginary ground for the tuning circuits. Coil 18 that comprises 16 turns is shorted to the said metallic termination plate.

The parameters of the resonator, which corresponds to the parameters given in Tables I–III for the electrical tune circuits, appear in FIG. 4.

Figure 5:
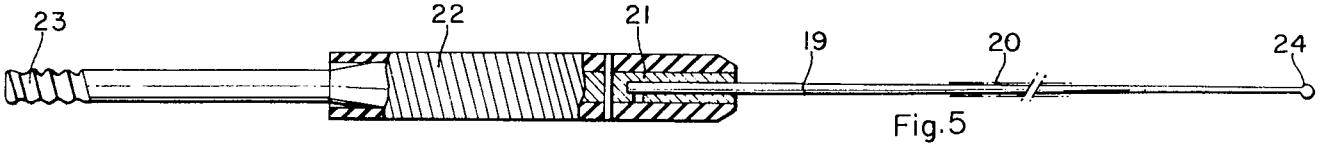
FIG. 5 shows an embodiment of the antenna whip.

The antenna whip illustrated in FIG. 5 comprises whip 19 made of 17-7PH stainless steel which is protected by a thin coat of backed polyurethane paint 20. The antenna whip is trapped in adaptor 21 made of SS-303 stainless steel.

A gripping sleeve 22 made of neoprene enwraps around the adaptor over a convenient section of its length for ease in handling when connecting and disconnecting the whip by means of a wide pitch screw arrangement 23 to the antenna coupler system. Said arrangement 23 can also match the socket means of the antenna basis AB-558/GR.

A small metallic sphere 24 at the needle-like top of whip 19 for protection against injury to personnel.

The dimensions of the antenna whip which best match components, the values given in Table I for the electrical tune circuits appear in FIG. 5.

The thin whip 19 has a cross-section diameter at the adaptor level of 3 mm and a cross-section diameter of 1.5 mm approximately at the top.

We claim:

1. An antenna coupler system and whip comprising:

A. a lower housing having a base being provided with connecting means for a vehicle; said housing containing a control unit comprising:

(i) a mechanical and electrical means connectable to a communication set;

(ii) a remote control multipin-connector;

(iii) a RF connector;

(iv) a control motor;

(v) a relay; and (vi) two rotary selection wafers;

said housing being connected via a flange to,

B. a second housing comprising:

(i) a helical-re-entrant-cavity resonator the parameters of which match an electronic tune system;

(ii) an electronic tune system, said system comprising:

(a) ten electrical tuning circuits composed of shorted line, inductors, and capacitors, each tuning circuit being designed to match the specific frequency sub-band within the 30–80 MHz frequency band and adjusted to the preselected height of the whip antenna;

(b) two top rotary selector wafers each arranged at one end of said tuning circuits;

said second housing being connected via an insulating bushing to

C. a base spring arrangement comprising at its upper end connecting means for

D. a removable antenna whip;

wherein both housings comprise a common rotatable axis which is located in the line of symmetry of the housings and antenna whip system; said rotatable axis being actuated by a control motor which comprises the mechanical link between the rotary selector wafers in both housings; the RF connector in the control unit being connected by way of a 50 ohms RF coaxial-line to the first rotary switch wafer of the electronic tune system; the shield of a section of the coaxial-line constituting the helical coil of the re-entrant-cavity resonator.

2. An antenna according to claim 1, wherein the first housing is made of aluminium.

3. An antenna according to claim 1, wherein the first housing is terminated at the lower end by an integrated sleeve for protection of the base connectors.

4. An antenna according to claim 1, wherein the control unit comprises an automatic and a manual frequency selector.

5. An antenna according to claim 1, wherein the second housing is made of armoured steel.

6. An antenna according to claim 1, wherein the helical-activity resonator is made of Noryl and plated internally with a metal, e.g. silver.

7. An antenna according to claim 1, wherein the electronic tune unit is mounted on a brass plate being coated with silver.

8. An antenna according to claim 7, wherein said plate constitutes also an internal surface of the resonator.

9. An antenna according to claim 1, wherein the antenna whip comprises:

a. the whip proper;

b. an adaptor; and c. the handle of the adaptor.

10. An antenna according to claim 9, wherein the whip and the adaptor are made of stainless steel and the handle of cast neoprene.

11. An antenna according to claim 1, wherein the top of the antenna whip is provided with a small metallic sphere.

* * * * *